US006776528B2

(12) United States Patent
Wills

(10) Patent No.: US 6,776,528 B2
(45) Date of Patent: Aug. 17, 2004

(54) PLASTIC BAG SUSPENSION DEVICE

(76) Inventor: David V. Wills, 8400 Brunswick Pl., Philadelphia, PA (US) 19153

( * ) Notice: Subject to any disclaimer, the term of this patent is extended or adjusted under 35 U.S.C. 154(b) by 0 days.

(21) Appl. No.: 09/795,228

(22) Filed: Feb. 28, 2001

(65) Prior Publication Data

US 2002/0116796 A1 Aug. 29, 2002

(51) Int. Cl.[7] ..... B65D 33/06
(52) U.S. Cl. ..... 383/15; 294/137; 294/158
(58) Field of Search ..... 294/137, 147, 294/158; 428/100; 224/901.4; 383/15, 11; 24/442

(56) References Cited

U.S. PATENT DOCUMENTS 3,203,551 A * 8/1965 Van Loan, Jr. ..... 210/486
3,370,818 A * 2/1968 Perr ..... 114/343
3,403,429 A * 10/1968 Smith ..... 24/306
3,542,041 A * 11/1970 Mercorella ..... 132/273
3,543,977 A * 12/1970 Lockridge ..... 128/DIG. 15
3,668,780 A * 6/1972 Cowdrey ..... 30/178
3,994,048 A * 11/1976 Rosenthal ..... 24/16 R
4,079,767 A * 3/1978 Howard ..... 224/235
4,091,766 A * 5/1978 Colliard ..... 119/858
4,120,437 A * 10/1978 Hara ..... 24/306
4,262,385 A * 4/1981 Norman ..... 112/441
4,384,021 A * 5/1983 Aoyama ..... 139/407
4,386,724 A * 6/1983 Kotler ..... 224/255
4,498,615 A * 2/1985 Johnson ..... 224/274
4,639,980 A * 2/1987 Peterson ..... 128/DIG. 14
4,884,323 A * 12/1989 Provost et al. ..... 24/306
4,893,381 A * 1/1990 Frankel ..... 24/16 R
4,982,885 A * 1/1991 Severson et al. ..... 224/675
5,075,934 A * 12/1991 Osedo ..... 24/16 R
5,098,324 A * 3/1992 Isono et al. ..... 428/100
5,120,300 A * 6/1992 Shaw ..... 128/876
5,171,253 A * 12/1992 Klieman ..... 128/DIG. 15
5,378,522 A * 1/1995 Lagomarsino ..... 24/306
5,433,359 A * 7/1995 Flowers ..... 224/222
5,436,051 A * 7/1995 Donaruma et al. ..... 24/448
5,469,601 A * 11/1995 Jackson ..... 16/421
5,511,313 A * 4/1996 Yoder et al. ..... 30/228
5,542,730 A * 8/1996 Riesselmann ..... 239/525
5,656,351 A * 8/1997 Donaruma ..... 24/442
5,697,661 A * 12/1997 Robinson et al. ..... 294/142
5,762,241 A * 6/1998 Cross ..... 224/173
6,205,623 B1 * 3/2001 Shepard et al. ..... 24/30.5 R

* cited by examiner

*Primary Examiner*—Jes F. Pascua
(74) *Attorney, Agent, or Firm*—Volpe and Koenig, P.C.

(57) ABSTRACT

Cooperating strips respectively having loop-type and hook-type connector surfaces are passed through loops forming handles of carrying bags to retain the carrying bags as a group. The ends of the strips, which are typically taken from supply rolls have saw tooth ends, and are heat sealed for protection against fraying. In one embodiment, the strips are aligned end to end. In another embodiment, the loop-type and hook-type connections are staggered so that a first end of one of the strips lies intermediate the ends of the other strip, and whereby the opposite end of the first strip, after being passed through the handles of the bags is brought around so as to lie adjacent to the first end of the first strip. A method is provided for forming the hook-type and loop-type strips to prevent fraying due to use.

3 Claims, 4 Drawing Sheets

FIG. 2a
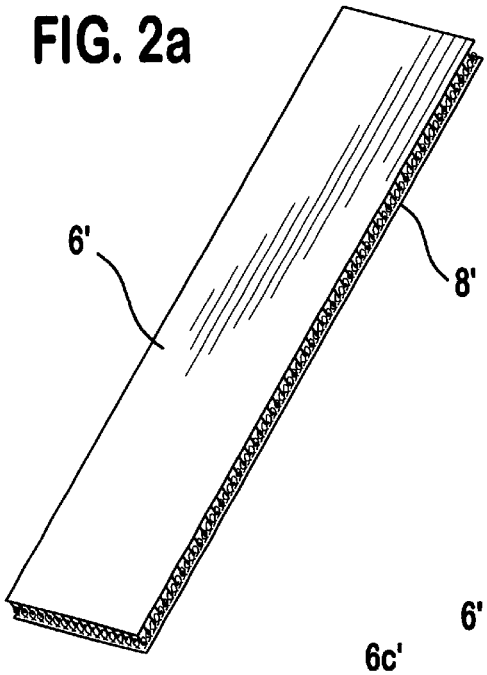
FIG. 2b
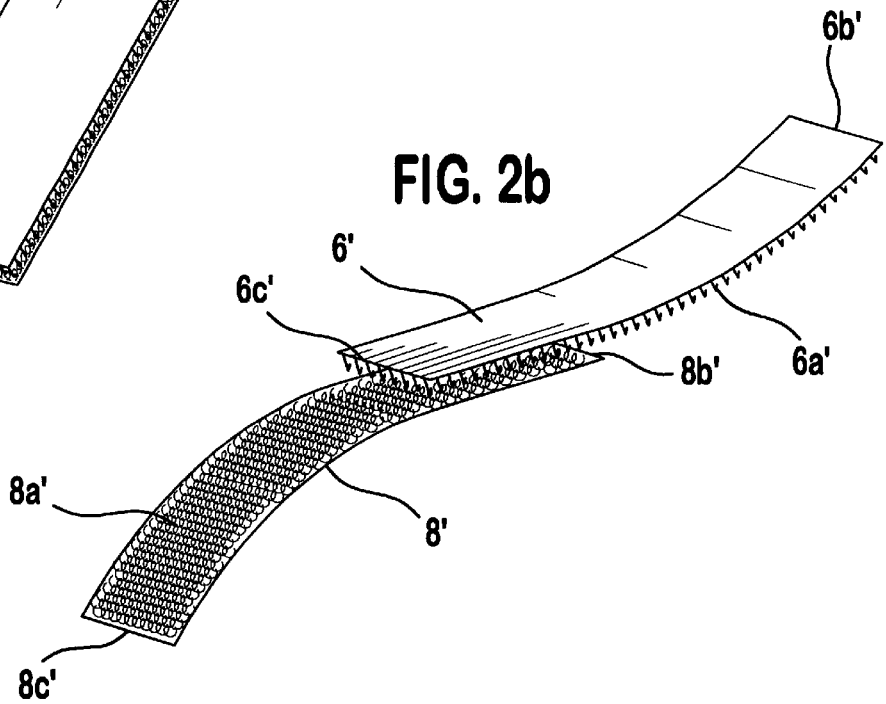
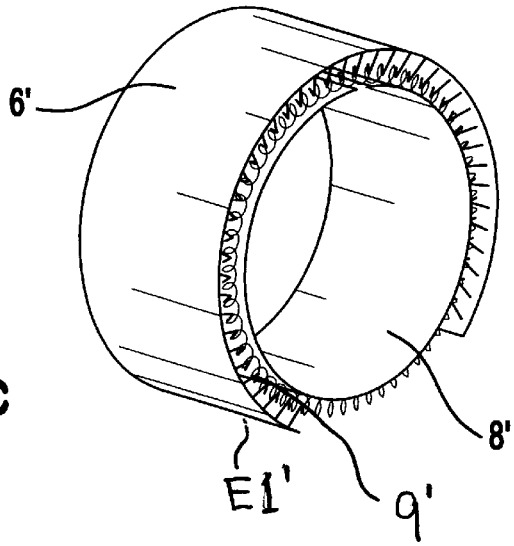
FIG. 2c

PLASTIC BAG SUSPENSION DEVICE

BACKGROUND

The present invention relates to bags having carrying loops and more particularly to a novel holding device for gathering and holding plastic bags.

SUMMARY

Shoppers frequently make a number of purchases either at the same or different stores, which purchases are "bagged" in separate bags, typically thin plastic bags having cut outs near the top thereof which are designed to function as carrying handles. During the course of shopping the bags of purchased items are typically set down and picked up on a number of occasions, for example, when paying for a subsequent purchase, when waiting for public transportation and so forth.

It is rather tedious to gather up the carrying bags after they have been set down since they are not stiff and the open ends thereof tend to droop over when not being held. This is especially true of thin gauge plastic shopping bags. It thus becomes advantageous to provide some means for facilitating the gathering and lifting of a number of bags in such a way that the carrying "handles" thereof are easily identified, grouped and grasped.

The present invention is characterized by comprising cooperating hook-type and loop-type tape sections one of which may be inserted through the bag loops forming the bag handles to gather the bags together and to secure the group of bags with a cooperating other one of the loop-type and hook-type tape sections. Using a loop of such tape, it is also possible to group the bags to thereby identify those bags which may contain groceries, for example, and those bags which may contain clothing, each grouping being separately identifiable from the other by the tape looped there through and having indicia written or non-toxic flourescent, colored tape very visible in nightlight printed thereon, if desired.

The hook-type and loop-type strips employed for this purpose are each typically drawn from a tape supply wound in roll form. An appropriate length of each strip is cut away from the supply roll (typically 4 inch lengths) and the strips are preferably cut using pinking shears or the like. Strips cut in this manner are comprised of both a hook type strip and a loop type strip, which strips are preferably formed of synthetic fibers and include a fabric-type strip respectively having a surface of hook-type and loop-type elements. Both ends of each of the strips are simultaneously cut and heat sealed by application of instantaneous arc spark on the synthetic strips, to accomplish both cut and seal simultaneously at both ends and to fuse the plastic material to protect against unraveling.

The strips, which have been prepared in the manner set forth hereinabove and comprising cooperating hook type and loop type strips, are placed about the handles of the bags and joined together to retain the group of bags, enabling the bags within the group to be carried, set down and picked up in a simple and convenient manner and wherein the hook type and loop type strips are joined together by pressing the hook-type and loop-type surfaces firmly into one another to enable the formation of a joined pair of strips which encircle the handles of the group of bags.

In still another embodiment, loop type and hook type strips which have preferably been cut employing pinking shears and heat sealed to fuse their ends, are pressed together and thereby joined in a staggered fashion so that a portion of each of the loop type and hook type joining surfaces are exposed at the ends of the joined members. The joined strips are then arranged to form a loop which passes around the bag handles and are secured with the exposed loop type surface joining the exposed hook type surface, the loop of staggered members encircling the handles of the desired group of bags in order to retain the bags within a group and in a manner similar to the first embodiment described herein above, to enable each group of bags to be easily recognized, one group from the other, picked up, set down and picked up again in an easy and convenient manner.

The cooperating hook type and loop type strips may be used and reused many times without the danger of fraying due to the pinking and heat sealing of the ends thereof.

It is therefore one object of the present invention to utilize cooperating hook type and loop type strips which are looped around and encircle the handles of thin gauge plastic bags to maintain the bags in a group and to facilitate their handling and carrying and wherein the hook type and loop type strips are treated to prevent fraying.

BRIEF DESCRIPTION OF THE DRAWINGS

The above as well as other objects of the present invention will become apparent in reading the accompanying description of the drawings in which:

FIGS. 2*a* through 2*c* show hook-type and loop-type strips employed in the third embodiment of the present invention.

DETAILED DESCRIPTION OF THE PREFERRED EMBODIMENTS

Figure 3B:
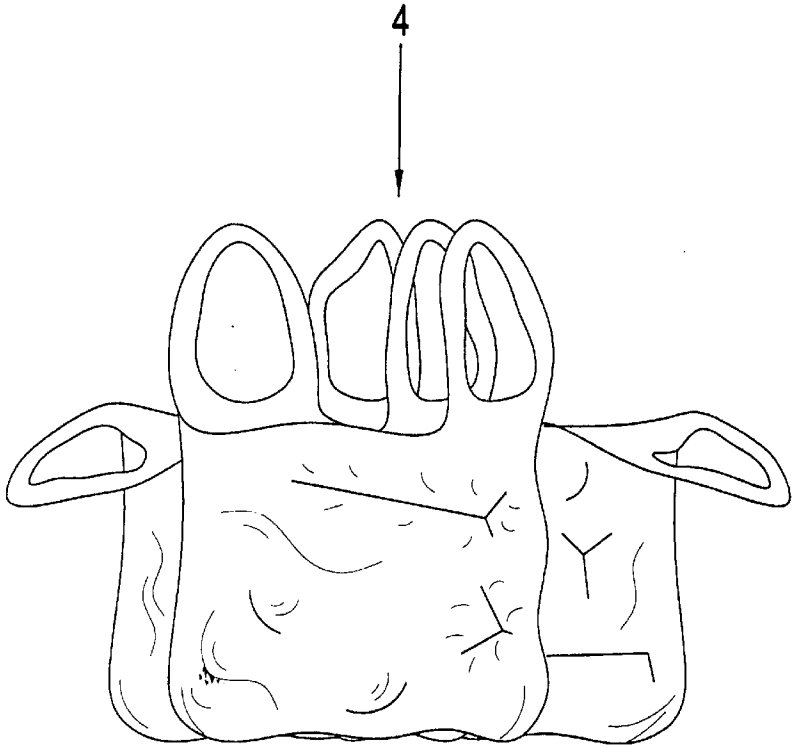
FIGS. 3*a* and 3*b* show a number of plastic carrying bags which have been generally arranged into first and second groups.
Figure 3A:
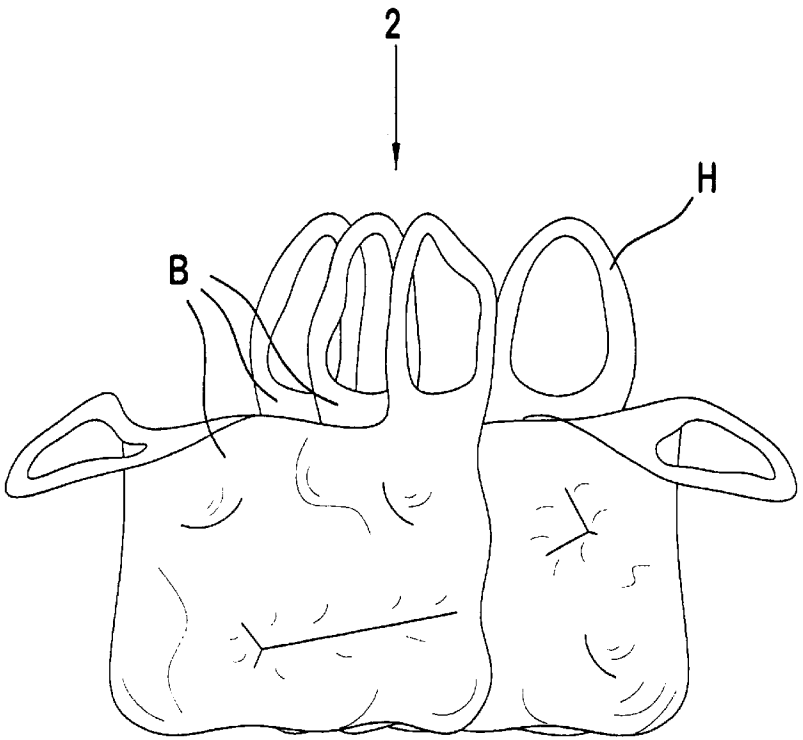

Making reference to FIGS. 3*a* and 3*b*, there is shown therein a plurality of plastic carrying bags which are generally divided into first and second groups 2 and 4. The carrying bags are conventional carrying bags found in most department stores, grocery stores and supermarkets as well as retail establishments of all types and sizes. The carrying bags are of a very thin gauge plastic, in most cases being thin enough to be translucent, if not transparent. The bags are of such thin gauge as to lack any rigidity or stiffness and are incapable of being self supporting in the absence of placement of any items or stiffening means therein such as a paper shopping bag. Even after items are placed in the bags, the top ends of the bags B having handle portions H typically droop downwardly. As a result, even though the bags are divided into distinct groups 2 and 4, it is quite tedious to identify each group of bags one from the other and gather up the handle portions H in order to carry the group of bags from one place to another and this occurs each time the bags are set down and thereafter picked up.

Figure 1A:
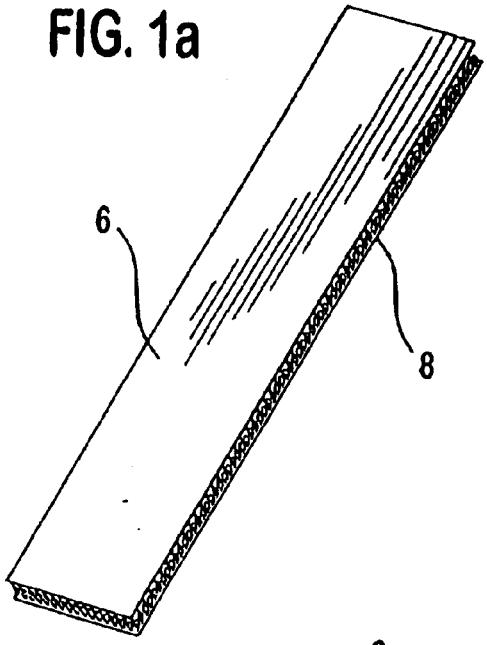
FIGS. 1*a* through 1*c* show hook-type and loop-type strips employed in the first embodiment of the present invention.
Figure 1B:
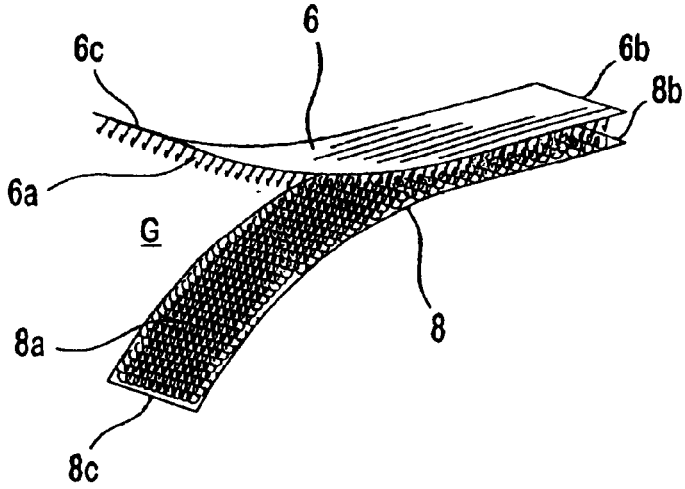
Figure 1C:
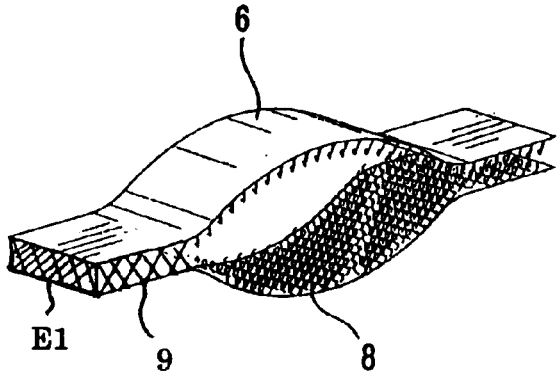

FIGS. 1*a* through 1*c* show one preferred embodiment of the present invention in which a cooperating strip having a hook-type material arranged on one surface thereof, i.e., surface 6*a* and a tape strip 8 having a surface 8*a* provided with loop-type material thereon. FIG. 1*a* shows the two strips 6 and 8 joined to one another from one end to the next. FIG. 1*b* shows the strips 6 and 8 partially joined at the right-hand ends thereof and split apart over a remaining portion thereof, while FIG. 1*c* shows strips 6 and 8 ends joined together and separated near an intermediate portion thereof to form an open gap region G.

Figure 5:
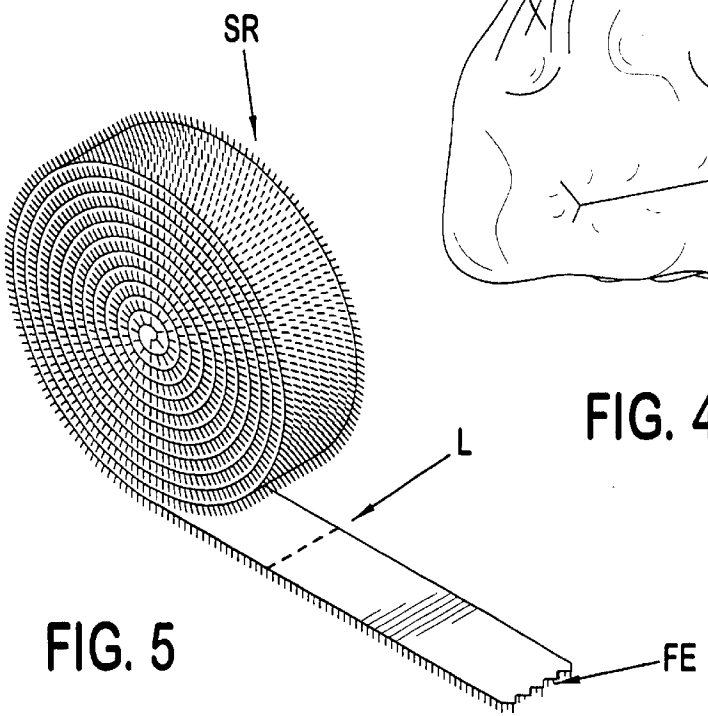
FIG. 5 is a perspective view of a supply roll of a hook-type material.

The strips are typically drawn from a supply roll such as the supply role SR shown in FIG. 5. The example given in FIG. 5 will be described for a supply roll of hook-type material, it being understood that strips of loop-type material are also typically provided in the form of a similar supply roll, a description of both types of supply rolls being omitted herein for purposes of brevity. The nature of the strips are such that it is possible to write or print identifying indicia on the surface of the strips opposite the loop-type or hook-type surface to identify the group of bags held together by the strips, such as "clothing", "groceries", "canned goods", "paper goods", etc.

A portion of the strip is unwound from supply roll SR of an amount or length sufficient to provide a strip of a desired length (4 inches in one preferred example). The strip is cut at a location L inwardly from the free end FE to form a strip of the desired length. The cut made along dotted line L is preferably made with a pinking shears to form a saw-tooth configuration which is shown at free end FE being the cut previously made to form a strip of loop-type material similar to the one presently being prepared. By cutting the ends with a pinking shears, the saw tooth configuration formed at both ends serves to prevent fraying of the ends, such as free end FE. After the hook-type and loop-type strips are cut to size in the manner described hereinabove, the ends (such as FE) are heated to fuse the plastic material utilized to form the hooks and loops, which fusion due to the heat sealing protects the ends of the strips from fraying.

In addition, it is also possible to seal one end of each loop-type strip to the associated end of a cooperating hook-type strip, by a seal 9 shown in crosshatch, thereby joining the cooperating strips 6 and 8 at one end thereof, for example, at end E1, shown in FIG. 1*c*, which arrangement assures that the strips 6 and 8 will be retained together even in the event that they have been split apart preparatory to their use.

In use, at least one of the strips 6 or 8 is passed through the loops forming the handles H of the a group of bags such as, for example, the group 2 of bags B shown in FIG. 3*a*. The central portion of the joined strips 6 and 8 will form a gap G as shown in FIG. 1*c* which is the region in which the handles H of the group of bags 2 are located. The use of the cooperating hook type and loop type strips makes it both easy and convenient to identify and lift up the bags as one group.

FIGS. 2*a* through 2*c* show still another embodiment of the present invention in which a strip 6' having loop-type material on surface 6*a*' is joined to a strip 8' having a hook-type surface 8*a*', the strips 6' and 8' being staggered so that one end 8*b*' of strip 8' is arranged intermediate at the ends 6*b*', 6*c*' of strip 6'. Using this embodiment, a loop can be formed of the strips 6' and 8' in the manner shown in FIG. 2*c* wherein the ends 6*b*' and 8*c*' are looped around so as to bring the end 8*c*' in close proximity to the end 8*b*' of strip 8' and similarly to bring the end 6*b*' of strip 6' in close proximity to the end 6*c*' of strip 6'. Obviously, before looping these strips in the manner described, the strips are inserted through the handles H of the group 4 of plastic bags shown in FIG. 3*a*. The hook-type and loop-type materials are then pressed together to join the strips.

Figure 4B:
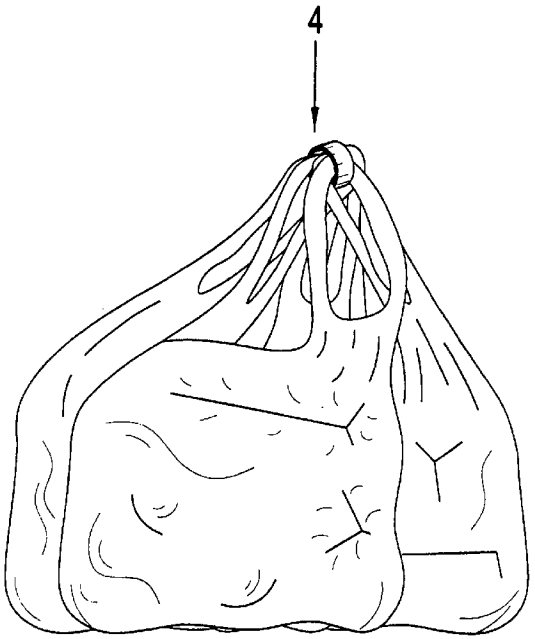
FIGS. 4*a* and 4*b* show the first and second groups of plastic bags respectively shown in FIGS. 3*a* and 3*b* and wherein the hook-type and loop-type strips respectively shown in the first embodiment of FIGS. 1*a* through 1*c* and the second embodiment shown in FIGS. 2*a* through 2*c* are utilized to encircle the carrying handles of the first and second groups of carrying bags.
Figure 4A:
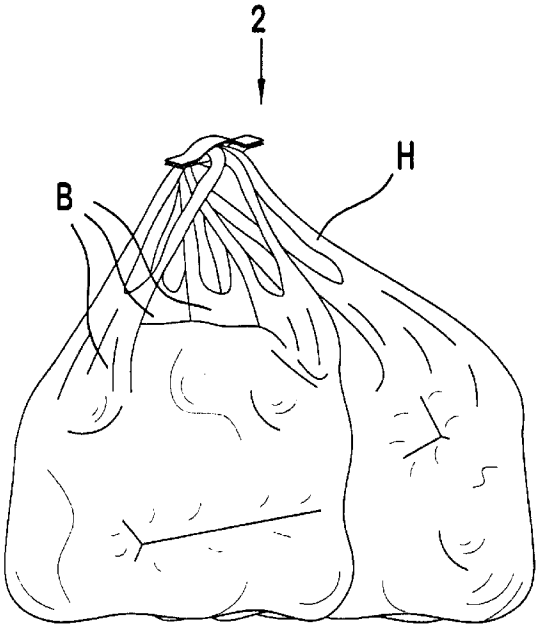

FIGS. 4*a* and 4*b* show the manner in which the groups 2 and 4 of the bags B are conveniently arranged making it quite easy to identify and thus grasp the handle H of each group of bags and, making it easy to do so each time the bags are set down and picked up again. In the embodiment shown in FIG. 2*c* the strips 6' and 8' may be sealed together by a seal 9' over the joined portion E1' or any lesser portion thereof, thereby assuring that the strips 6' and 8' are secured to one another even when the strips 6' and 8' are split apart in order to be looped about a group of bag handles H.

The handles H of the plastic bags are utilized to carry the bags in the conventional manner, the strips 6 and 8 (and 6' and 8') being utilized to retain the bags in a well defined group. However, if desired the joined strips may be used as handles. Also, the cooperating strips may be used to carry other groups of bags having handles such as paper bags or cloth bags.

Plastic shopping bags of the type described herein are known to cut into the hands, especially when carrying heavy items. In order to alleviate this, the strips may be held between the bag handles and the hand to alleviate this matter. In such applications the strips may be provided to have greater width in order to cover a wider area of the hand and protect the holder's hand against the handles cutting into the hand.

What is claimed is:

1. Apparatus for retaining handles of a group of bags comprising a first member comprised of a first elongated strip having substantially parallel opposing side edges and being provided with a loop-type fabric on one surface thereof and a second member comprised of a second elongated strip having opposing parallel side edges and a hook-time fabric on one surface thereof, said loop-type and hook-type fabrics being joined together; opposite ends of said members aligned transverse said opposing side edges having a saw tooth configuration to prevent fraying, said hook-type and loop-type fabric being farmed of plastic; and the ends of both of said members being heat sealed along an entire length of each end to prevent fraying; said first and second strips being joined together so as to encircle the handles of said bags to enable the encircled handles to be gripped by a hand for carrying, said bag handles being the only means for carrying the encircled bag handles by hand, wherein said hook-type and loop-type fabrics are arranged in a loop so that:

(a) a first end of said hook-type fabric is joined to a first end of said loop-type fabric in a staggered manner;

(b) a second end of said hook-type fabric is joined to a second end of said loop-type fabric in a staggered manner; and (c) said loop being of sufficient size to encircle said handles.

2. The apparatus of claim 1 wherein the hook-type and loop-type surfaces are formed of plastic and said first end of said hook-type fabric is joined to said first end of the loop-type fabric by heat sealing said first ends in the joined condition.

3. The apparatus of claim 1 wherein the hook-type and loop type fabrics are of width to cover a sufficient area of a holder's hand to protect holder's hand against the bag handles cutting into the holder's hand.

* * * * *